US006520324B1

(12) United States Patent
Matthews et al.

(10) Patent No.: US 6,520,324 B1
(45) Date of Patent: Feb. 18, 2003

(54) DISPLAY UNIT FOR A CONSUMER ARTICLE

(75) Inventors: Scott B. Matthews, Waterbury, CT (US); Richard W. Gursky, Sr., Oakville, CT (US); Gerald A. DiMarco, Poughkeepsie, NY (US)

(73) Assignee: Timex Group B.V. (NL)

( * ) Notice: Subject to any disclaimer, the term of this patent is extended or adjusted under 35 U.S.C. 154(b) by 0 days.

(21) Appl. No.: 09/920,901

(22) Filed: Aug. 2, 2001

(51) Int. Cl.[7] ..... B65D 85/40
(52) U.S. Cl. ..... 206/301; 206/18; 206/764
(58) Field of Search ..... 206/6.1, 18, 301, 206/764, 765, 771, 775, 807

(56) References Cited

U.S. PATENT DOCUMENTS 5,383,552 A * 1/1995 Dikowitz ..... 206/301
5,579,906 A * 12/1996 Fabbri et al. ..... 206/301
5,752,600 A * 5/1998 Kurashina et al. ..... 206/301
5,810,165 A * 9/1998 Lai ..... 206/18
5,873,457 A * 2/1999 Madweb ..... 206/1.5
6,257,399 B1 * 7/2001 Gursky et al. ..... 206/301

* cited by examiner

*Primary Examiner*—Luan K. Bui
(74) *Attorney, Agent, or Firm*—Carmody & Torrance LLP

(57) ABSTRACT

A display unit for a consumer article comprising a housing, a mount disposed in the housing, wherein the mount comprises at least one aperture therethrough, and an article support unit, the article support unit comprising an article support platform for supporting a consumer article, a cap, the cap being coupled to the article support platform and positionable on the mount, the cap further comprising at least one aperture in at least essential alignment with the at least one aperture in the mount, a tongue member, the tongue member extending from the article support unit and including a tab on a surface thereof, wherein the tab cooperates with a side wall of the housing to releasably lock the article support unit in place when the cap is positioned on the mount, wherein the side wall provides for the decoupling of the tab therefrom, and a connector, threadable through the respective apertures of the cap and the mount, for maintaining a coupling of the cap and the mount when the tab of the tongue is decoupled from the side wall of the housing and the cap is removed off of the mount. The maintenance of a coupling of the cap and the mount discourages the unauthorized decoupling and removal of the article support unit and the article from the housing.

18 Claims, 4 Drawing Sheets

DISPLAY UNIT FOR A CONSUMER ARTICLE

BACKGROUND OF THE INVENTION

The present invention relates generally to display units for protecting consumer articles from theft, and more particularly, to an improved construction of a display unit for securely storing and displaying consumer articles such as timepieces, while at the same time facilitating inspection and appreciation of the consumer article by the potential consumer prior to purchase.

It is well known to provide a package or display box for storing and displaying a consumer article during shipping and for exhibiting the article for sale in retail sales establishments. Typically, a retail sales establishment will exhibit the consumer article, i.e. a timepiece, in its individual display box on a rack or, alternatively, may arrange the display box on a counter top so that a prospective purchaser may see and touch the consumer article. Such counter top exhibitions may include the consumer article within its display box or removed therefrom. To permit the exhibition of the consumer article within the display box, the display box typically has a transparent cover.

In order to permit a closer inspection of the consumer article, many prior art display boxes permit the consumer article to be removed therefrom. That is, if the consumer article is a timepiece for example, the timepiece and a C-shaped member of the display box may be removed from an interior cavity of the display box. The C-shaped member, generally referred to as a C-clip, is adapted to support the timepiece thereon. This manner of removal enables potential purchasers to more closely examine the timepiece to assist in their purchasing decision but, however, also increases the likelihood that the timepiece may be stolen.

To deter the theft of such consumer articles, it is well known to provide surveillance systems that include, for example, scanners which establish an electromagnetic or magnetic field at entrances and exits of the retail sales establishment. As is known, an electronic article surveillance (EAS) marker or tag may be attached to, for example, the display box or to the consumer article itself. When activated, the EAS marker interacts with the electromagnetic or magnetic field to indicate that the tagged article is entering the field. In this way, the presence of an active EAS marker activates an alarm indicating that a display box, i.e. the consumer article, containing an active EAS marker, is being removed from the premises.

The foregoing systems have been somewhat successful in deterring theft. However, in some conventional display box configurations an EAS marker may easily be removed to defeat the surveillance system. Further, certain merchandise such as, for example, timepieces, have heretofore not be able to be tagged with an EAS marker in a manner which ensures the ability to pick up and examine the timepiece while simultaneously reducing the likelihood of theft of the timepiece. Thus, one perceived deficiency in prior art display box arrangements is an inability to reliably discourage the theft of the consumer article itself.

Accordingly, an improved construction for securely storing and displaying a consumer article, such as a timepiece and watches in particular, and for more reliably reducing the likelihood of theft thereof, is desired. The present invention overcomes the aforementioned deficiencies and provides the objectives and advantages set forth below.

OBJECTS AND SUMMARY OF THE INVENTION

Therefore, it is an object of the present invention to provide an improved display unit for a consumer article for reducing or eliminating the theft thereof. In a preferred, yet non-exclusive use of the present invention, the consumer article, may be a timepiece, and more preferably a watch. Hereinafter however, reference to a consumer article should be understood to include watches, but not be limited thereto. Similarly, reference to a timepiece or watch should not imply limitations thereby, so that it should be understood that all references to timepieces, watches or other particular consumer articles should be understood to include consumer articles of all types and descriptions to which the present invention may be applicable for displaying.

It is another object and advantage of this invention to provide a consumer article display unit for securely storing and displaying a consumer article, while at the same time facilitating inspection and appreciation of the consumer article by the potential consumer prior to purchase.

Still other objects and advantages of the invention will in part be obvious and will in part be apparent from the specification.

The invention accordingly comprises the features of construction, combination of elements and arrangement of parts that will be exemplified in the disclosure hereinafter set forth, and the scope of the invention will be indicated in the claims.

The foregoing and other problems are overcome and the objects and advantages are realized by a display unit constructed in accordance with embodiments of this invention, wherein an improved arrangement for a consumer article display unit is disclosed.

Generally speaking, the present invention is directed to a display unit for a consumer article. In a preferred embodiment, the display unit comprises a housing, a mount disposed in the housing wherein the mount comprises at least one aperture therethrough, and an article support unit which itself may comprise an article support platform for supporting a consumer article, a cap being coupled to the article support platform and positionable on the mount and itself comprising at least one aperture in at least essential alignment with the at least one aperture in the mount, and a tongue member, the tongue member extending from the article support unit and including a tab on a surface thereof, wherein the tab cooperates with a side wall of the housing to releasably lock the article support unit in place when the cap is positioned on the mount. The sidewall of the housing preferably provides for the decoupling of the tab therefrom, such as, but not limited thereto, by including an aperture therethrough. A connector, threadable through the respective apertures of the cap and the mount, maintains a coupling of the cap and the mount when the tab of the tongue is decoupled from the side wall of the housing and the cap is removed off of the mount. In this way, there is a maintenance of a coupling of the cap and the mount to discourage the unauthorized decoupling and removal of the article support unit and the article from the housing.

In a specific embodiment of the present invention, the mount includes a second aperture and the cap includes a second aperture in at least essential alignment with the second aperture in the mount, wherein the connector is threadably looped through the respectively aligned apertures. The tab of the tongue member may be displaceable out of the aperture by the pressing of a finger of a user against the tab to release the tab from the aperture. When the tab is released from the aperture, the cap of the article support unit can be removed from the mount. When the article support unit is removed from the mount, the connector maintains a coupling of the mount and the cap.

In an alternate embodiment of the present invention, the display unit may further comprise facing brackets connected to an inner surface of a selected side wall of the housing, and the article support unit may further comprise a stabilizer member with the tongue member extending from the stabilizer member, such that when the cap is positioned on the mount, the stabilizer is disposed between the brackets to increase the securing, stabilization and positioning of the article support unit in the housing and in particular, on the mount.

BRIEF DESCRIPTION OF THE DRAWINGS

For a fuller understanding of the invention, reference is made to the following description taken in connection with the accompanying drawings, in which.

Identically labeled elements appearing in different ones of the above-described figures refer to the same elements but may not be referenced in the description for all figures.

DETAILED DESCRIPTION OF THE PREFERRED EMBODIMENTS

In the preferred embodiment, the consumer article may be a timepiece, and a watch in particular, but the invention is not limited thereby. Therefore, references to a watch, timepiece or other consumer article should be understood to be interchangeable references, and is intended by the disclosure as such.

Turning to the particular figures, reference will first be made to FIGS. 1–5 for a disclosure of the first embodiment of the present invention. The present invention, a display unit for a consumer article, is preferably comprised of a plurality of elements, one of which is a housing, generally indicated at 10 (FIGS. 1, 4 and 5), and an article support unit, generally indicated at 50 (FIGS. 2 and 3).

Figure 1:
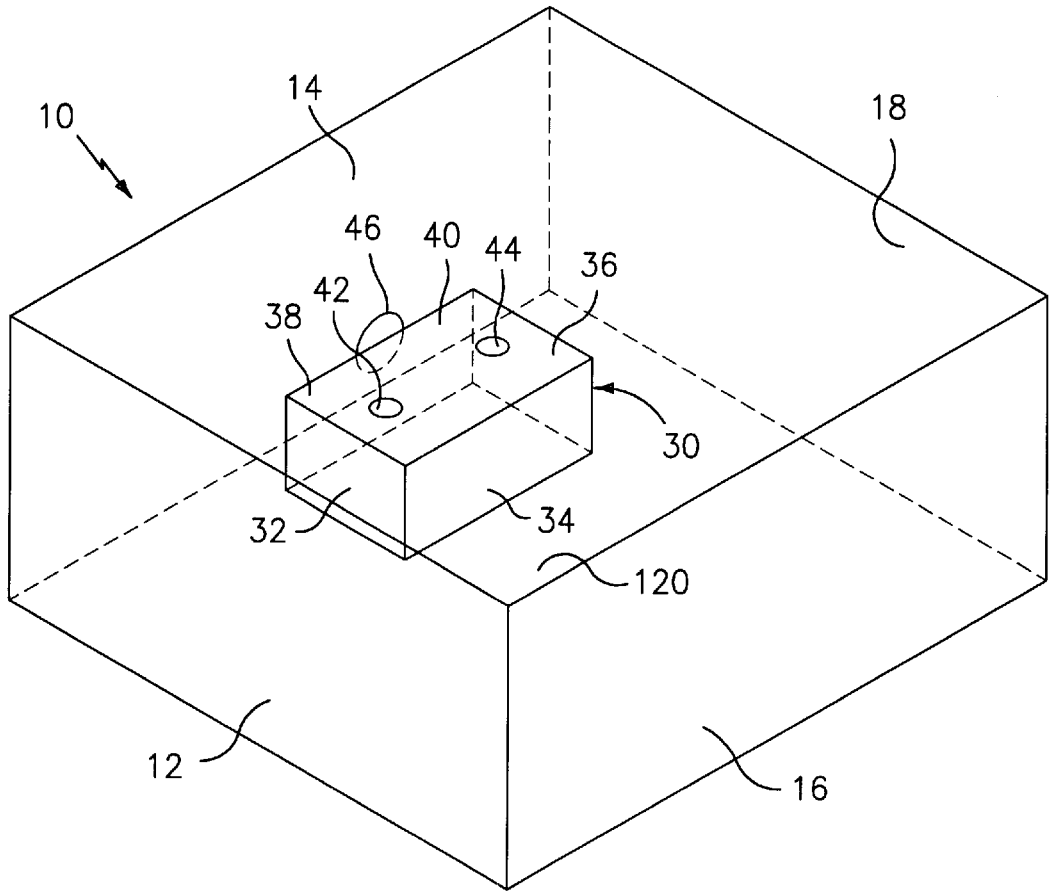
FIG. 1 is a perspective view of a portion of a housing for a display unit for a consumer article constructed in accordance with the present invention.
Figure 4:
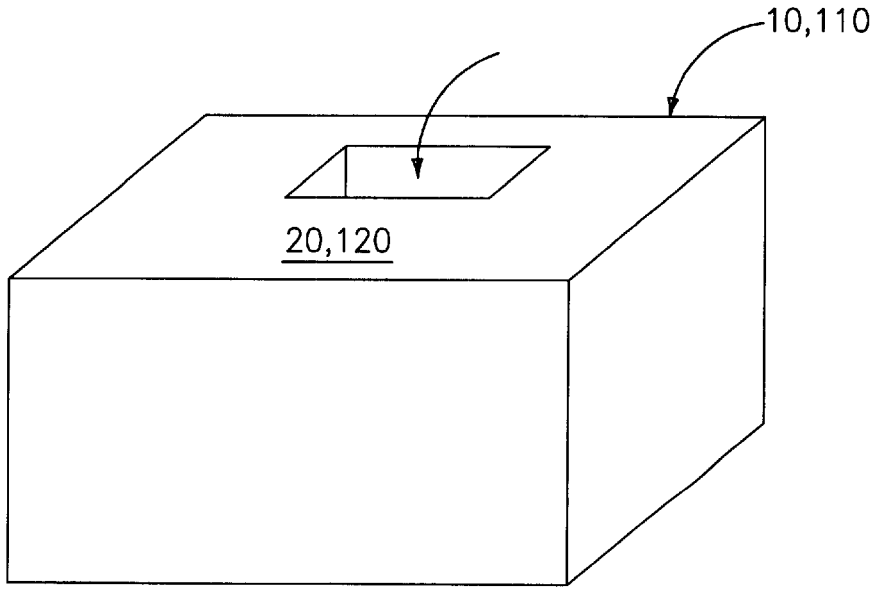
FIG. 4 is a perspective view of a portion of a bottom of the housing for the display unit illustrated in FIG. 1 and FIG. 6.

Housing 10, which in the preferred embodiment is rectangular or square, may comprise sidewalls 12, 14, 16, 18 and a bottom surface 20. A preferably rectangular shaped mount, generally indicated at 30, is disposed in housing 10 and protrudes upward from bottom surface 20. FIG. 4 more clearly illustrates how mount 30 is preferably formed as part of the mold for housing 10. Mount 30 itself may have four side walls 32, 34, 36 and 38 and a top surface 40, all which may be formed during the molding of housing 10 in a known manner.

Mount 30 includes at least one aperture 42, and preferably at least a second aperture 44, both of which are preferably, but not necessarily, through a top surface 40. Although a matter of design choice, mount 30 is preferably positionally molded so as to be closer to one side wall than directly in the middle of the housing compartment. This is clearly illustrated in FIG. 4, the arrow illustrating the interior cavity of mount 30 from the molding process. An aperture 46 to accept a tab (discussed below) is formed in one of the sidewalls (sidewall 14, by example). Aperture 46 may be round, oval or any other shape that coordinates with a tab 59 discussed below. In the preferred example, housing 10 is rectangular shaped, with sidewalls 14 and 16 being longer than opposing sidewalls 12 and 18. In this configuration, mount 30 is formed closest to sidewall 14 and hence aperture 46 is formed therethrough. However, one skilled in the art would understand that each of these minor details could be altered while remaining within the scope of the invention. For example, the entire housing 10 could be circular or oval, and the invention would still be appreciated. Likewise, mount 30 need not be rectangular, regardless of the shape of housing 10, and in fact may itself be round or oval. The important features however are apertures 42 and/or 44 (or other equivalent securing means as will be understood below) in the surface of mount 30 and aperture 46 in a sidewall, most preferably, but not necessarily, proximate mount 30. That is, aperture 46, as will be understood below, could, in theory, be in any sidewall of housing 10.

Figure 2:
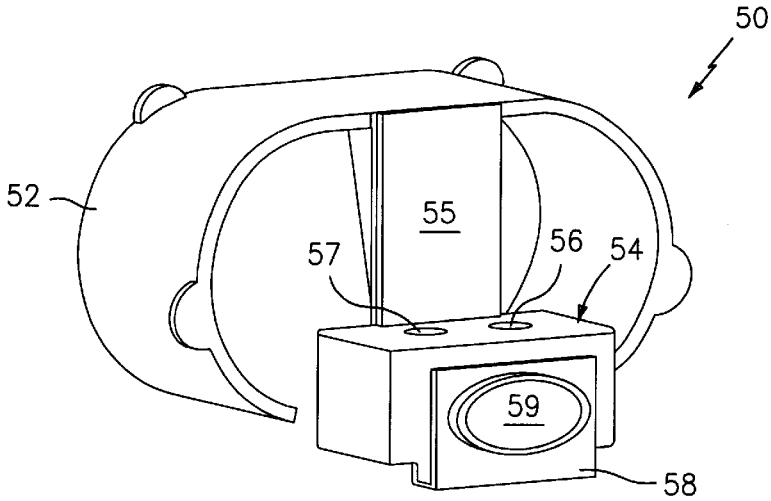
FIG. 2 is a perspective view of an article support unit constructed in accordance with the present invention and adapted to hold a consumer article, such as a watch.
Figure 3:
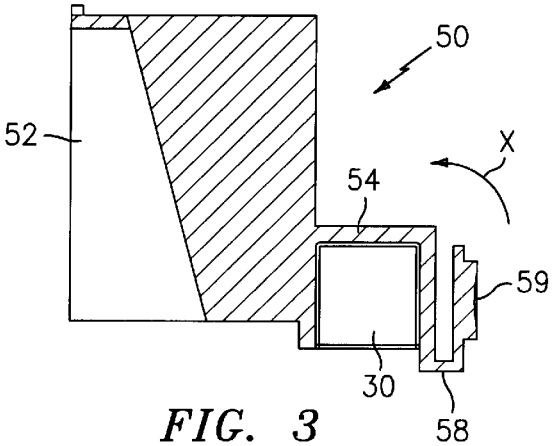
FIG. 3 is a side elevational view of the article support unit of FIG. 2.

Reference is now made to FIGS. 2 and 3 for a detailed description of article support unit 50. Specifically, article support unit 50 includes an article support platform 52 for supporting a consumer article, such as a watch (not shown). Article support platform 52 may have a "C-clip" shape as is well known in the watch industry for displaying watches and the like. Likewise it can be oval. However, the actual shape of article support platform 52 is really one of design choice.

Coupled to article support platform 52 is a cap 54. In the preferred embodiment, cap 54 is integrally formed with article support platform 52 via a molded neck 55 because the elements are formed together during molding. However, if so desired, the elements to form article support unit 50 can be joined together by adhesive or the like. Preferably, cap 54 has a shape complementary to mount 30 so as to be easily disposed thereon as described below. Cap 54, hollowed out on the inside, also includes at least one aperture 56, and preferably a second aperture 57, which are intended to be consistent with and at least essentially aligned, if not perfectly aligned, with the respective apertures 42 and 44 in mount 30. The reasons therefor will be further explained below.

Article support unit 50 further includes a tongue member 58 extending from the article support unit 50. In the preferred embodiment, tongue member 58 extends from cap 54. Tongue member 58 may also be integrally formed during the molding process of article support unit 50. A tab 59 is provided on the surface of tongue member 58 that faces away from unit 50 and towards the side wall (i.e. sidewall 14) to which tab 59 will releasably latch in the manner discussed below. For this reason, tongue member 58 is constructed to be sufficiently flexible so as to achieve its operational function which is described in detail below. In particular, tab 59 cooperates with aperture 46 in sidewall 14 of housing 10 so as to assist in releasably locking article support unit 50 in place when the cap 54 is positioned on mount 30. Accordingly, the shape of tab 59 should be the same as the shape of aperture 46.

As should now be understood, while the present invention has been described as utilizing a tab 59 on tongue 58 and a correspondingly aligned aperture 46 in sidewall 14, other configurations are contemplated herein and will fall within the scope of the present invention. For example, sidewall 14 need not have a full aperture 46 (i.e. that goes all the way through the sidewall (see FIG. 11)) but rather may have a cavity sufficient enough to capture tab 59 with a type of flexible member that when depressed from the outside of housing 10, achieves the same functionality as pushing tab 59 through aperture 46, namely, pushing tab 59 sufficiently out of the cavity so as to permit the decoupling of tab 59 from sidewall 14. In the preferred embodiment, tab 59 can be pushed out of aperture 46 by a human finger, for example.

Figure 5:
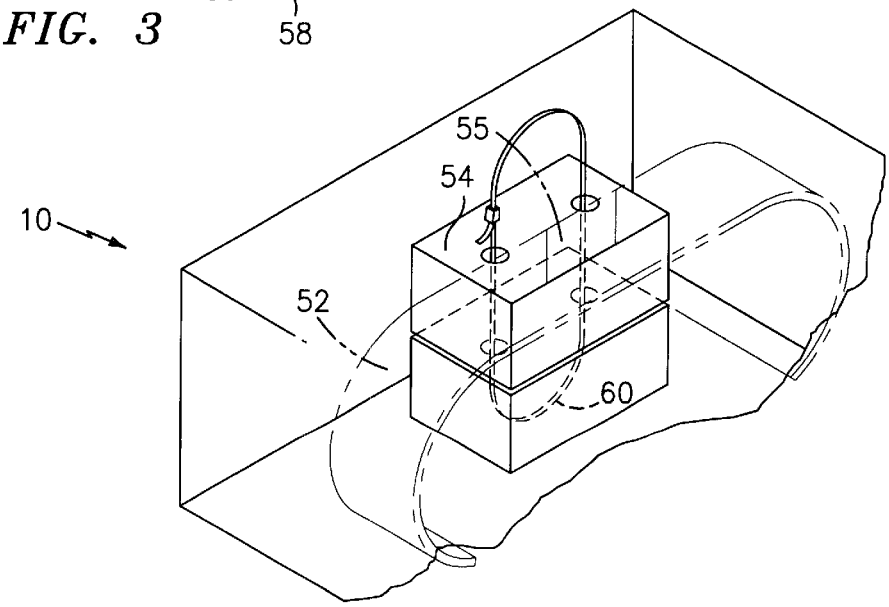
FIG. 5 is perspective view of the housing of FIG. 1 illustrating the coupling of the mount of the housing with the article support unit to provide a potential consumer with the opportunity for a more intimate and detailed inspection of the consumer article.
Figure 6:
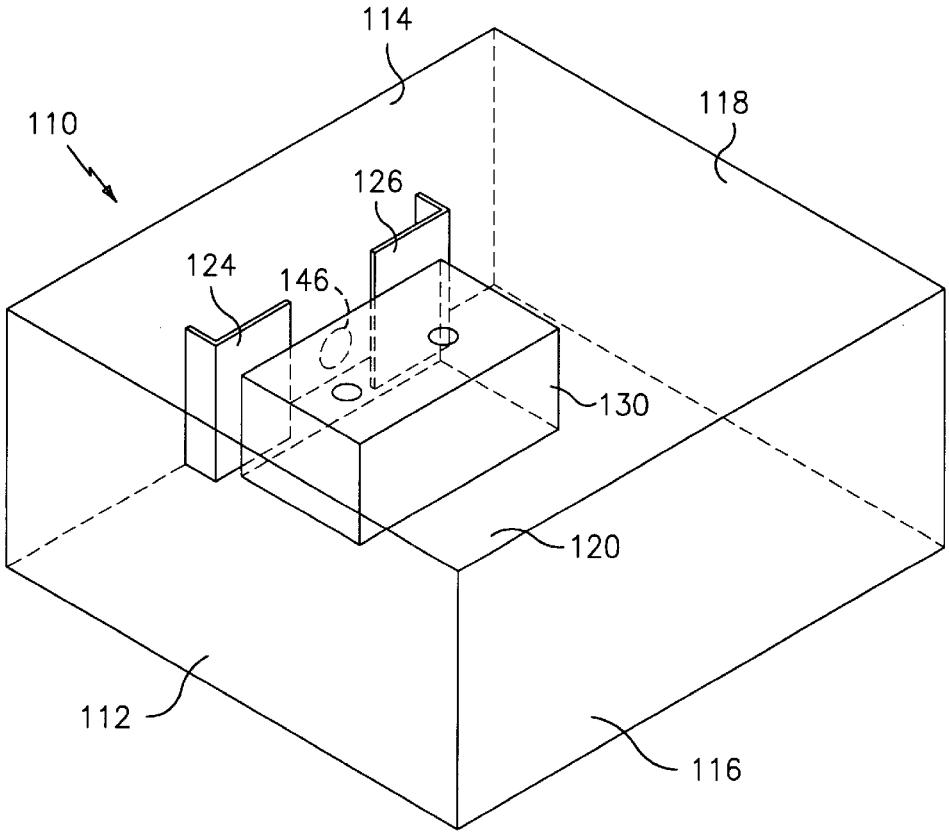
FIG. 6 is a perspective view of a portion of a housing for a display unit for a consumer article constructed in accordance with an alternate embodiment of the present invention.
Figure 7:
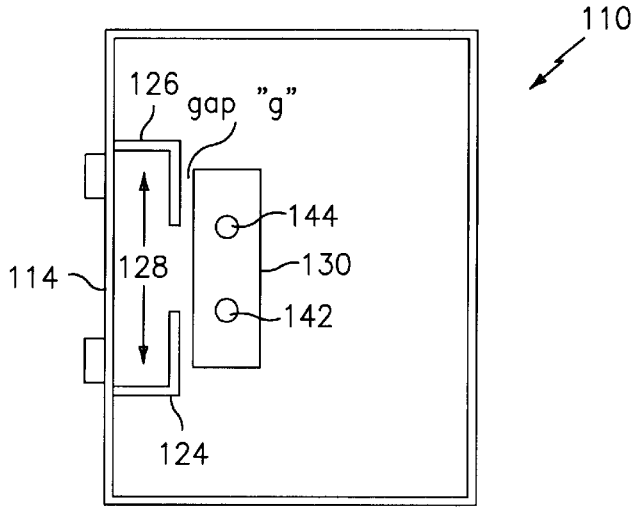
FIG. 7 is a top plan view of the housing illustrated in FIG. 6.

Lastly, a connector 60 (FIG. 5), such as those manufactured by 3M out of nylon or plastic, may be threaded through the respective apertures of cap 54 and mount 30 (note FIG. 5 does not show the entire article support unit 50 but rather only the parts sufficient to clearly and adequately disclose the present invention). As will now be understood, connectors and other plastic clips are well known so as to require only one aperture in each of the cap 54 and mount 30. In this way, no looping and coupling of the ends of the connector would be needed. However, in accordance with the preferred embodiment, because cap 54 and mount 30 each have two respective apertures, connector 60 can be looped and connected at the ends of connector 60. In this manner, connector 60 maintains a coupling of cap 54 (and hence article support unit 50) to mount 30 when tab 59 of tongue 58 is decoupled from side wall 14 of housing 10 and cap 54 is removed off of mount 30.

With the construction of the present invention's first embodiment now disclosed, much of the operation and advantages thereof should now be understood, although some particulars thereof will now be set forth to ensure completeness of the disclosure. Specifically, in operation, a watch or other consumer article is placed around article support platform 52. Article support unit 50 can then be placed in housing 10, and in particular, disposed onto mount 30. This is achieved by aligning and disposing cap 54 thereon. Cap 54 preferably is positionable entirely onto mount 30 such that the top surface 40 of mount 30 is in close proximity with the interior top surface of cap 54. Preferably, the respective aperture(s) (i.e. aperture 42 with aperture 56 and aperture 44 with aperture 57) will align. The position of aperture 46 (or other releasing mechanism) in sidewall 14 is preferably aligned with the position of tab 59 when cap 54 is sitting flush on mount 30. This would be quite clear to one skilled in the art. In this manner, when cap 54 is fully positioned on mount 30, the biasing of tongue 58 will cause tab 59 to "snap" into aperture 46. As cap 54 is being lowered onto mount 30, tab 59 may be flexibly biased against sidewall 14 causing tongue 58 to be biased in direction X (FIG. 3). In this way tab 59 will easily and timely "snap" into aperture 46 in a direction opposite of arrow X.

Figure 11:
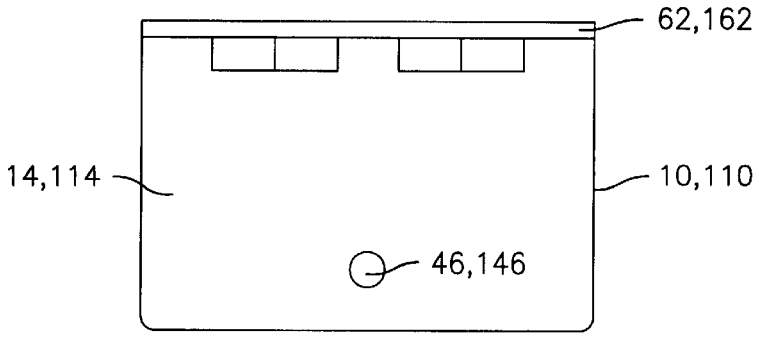
FIG. 11 is an end view of the housing constructed in accordance with either the first or the second embodiment.

Thereafter, during finalization of the display unit, connector 60 is looped through the respective apertures as shown in FIG. 5 and thereafter connected at the ends thereof. A cover 62 may be utilized and placed onto housing 10 as illustrated in FIG. 11. Corresponding hinge as would be understood in the art, may secure cover 62 to housing 10. After connector 60 is secured, the objective is not to disconnect (i.e. cut) connector 60 until the consumer article is purchased.

In the marketplace (i.e. in retail stores), the present invention is quite advantageous over prior art display box constructions. In particular, the present invention affords a potential consumer the ability to open the display unit cover 62, touch and inspect the consumer article, and now, utilizing the features of the present invention, further provides the ability of the user to remove the consumer article from the housing (although it will remain on the article support platform 52) and more intimately inspect and admire it. Removal of the consumer article from housing 10 is achieved by releasing tab 59 of tongue member 58 from aperture 46 with a digit or thumb of a hand (not shown). Thereafter, the entire article support unit 50 can be removed from mount 30. Importantly however, is the critical feature that article support unit 50 remains coupled to housing 10 via the coupling of mount 30 to cap 54 through the use of connector 60. While the potential consumer is afforded the foregoing abilities, the retailer or merchant is afforded a greater degree of comfort that the consumer article alone or with the article support unit 50, will not be concealed and removed from the store in an unauthorized manner. As stated above, the consumer article itself may be secured to the article support unit 50 by a separate tie, wrap, or other security type feature. The consumer is discouraged from taking the consumer article in an unauthorized manner for a variety of reasons, such as because housing 10 would also have to be concealed, a much harder objective than, for example, merely just wearing the watch out of the store. Also, a security device may now be easily placed in or on the housing 10. After inspecting the article in accordance with the foregoing but without purchasing it, merely replacing the article support unit 50 onto mount 30 resets the display for the next potential customer, as connector 60 remains in tact.

Reference is now made to FIGS. 6–10, in connection with the following description, in which an alternate embodiment of a display unit in accordance with the present invention is disclosed.

This alternate embodiment has many features corresponding exactly to features of the first embodiment so that details thereof will be omitted, as they should be well understood by one skilled in the art. The differences worth noting between the two embodiments, however, will be discussed in detail.

Generally speaking, the display unit corresponding to this alternate embodiment comprises housing 110 which in many respects is similar to housing 10, such as in inclusion of side walls 112, 114, 116, 118 and a bottom surface 120. A mount 130, similar to mount 30, may be molded therein. In all respects, mount 130 may be similar to mount 30 (i.e. with similar apertures 142, 144, etc.).

Housing 110 differs from housing 10 in really one significant respect, but it should be noted that the claims are intended to cover both embodiments and equivalents thereof. Specifically, in this second embodiment, housing 110 includes preferably "L-shaped" brackets 124, 126. The function of brackets 124 and 126 will become apparent in a moment. Bracket 124 may be connected to an inner surface of a selected side wall (i.e. side wall 114) of housing 110 and bracket 126 may also being connected to the inner surface of the selected side wall 114 and in facing alignment with the first bracket 124. These brackets 124, 126 may be integrally molded to side wall 114 or adhered thereto in any known manner, i.e. adhesive, etc. A slot 128 is thereby created between sidewall 114 and brackets 124 and 126.

Figure 8:
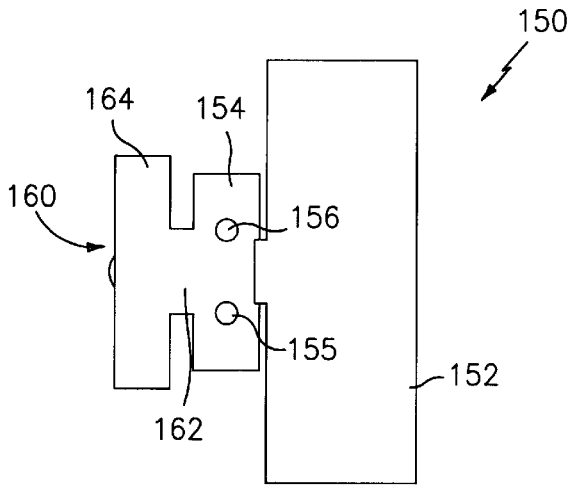
FIG. 8 is a top plan view of an article support unit constructed in accordance with the present invention and for use in combination with the housing of FIG. 6.
Figure 9:
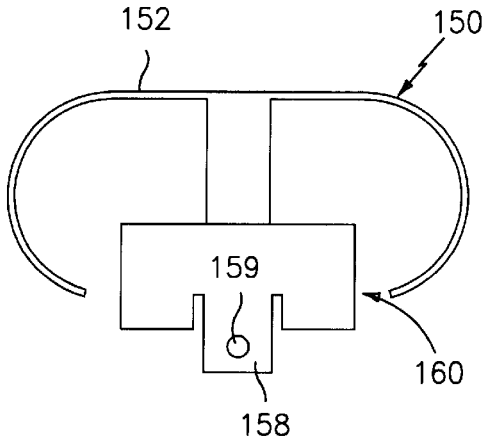
FIG. 9 is an end view of the article support unit of FIG. 8.
Figure 10:
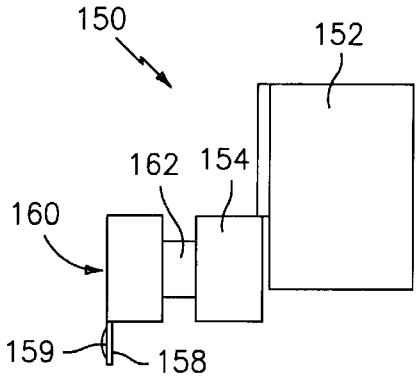
FIG. 10 is side view of the article support unit of FIG. 8.

Turning to FIGS. 8–10, reference will now be made to a detailed description of article support unit 150. Article support unit 150 is similar to article support unit 50 in many respects, all of which should become apparent to one skilled in the art after reviewing the figures in conjunction with this disclosure. However, the differences between the respective article support units will now be highlighted.

In particular, article support unit 150 also includes an article support platform 152 for supporting the consumer article, and may be of a similar "C-clip" shape. For exemplary purposes, support platform 152 is shown in FIG. 9 as being somewhat "ovalish" in shape. Coupled to article support platform 152 is a cap 154, similar in all respects to cap 54, and therefore details thereof shall be omitted for brevity. For example, cap 154 includes apertures 155 and/or 156 as discussed above with respect to cap 54. Cap 154 may therefore be considered constructed in all significant ways in a manner similar to cap 54. However, differing from article support unit 50 is that article support unit 150 includes a stabilizer member 160 coupled to, or integral with article support unit 150, and in particular, as illustrated in the figures, integral with cap 154. A neck 162 forms the connection between stabilizer 160 and cap 154. As an aside, it should be noted that all the figures may not be scaled in perfect relation to one another. For example, FIG. 8 may not be considered scaled perfectly with respect to FIG. 7 since the neck 162 of FIG. 8 may be considered not to appear to fit in the gap "g" between brackets 124, 126 and mount 130 in FIG. 7. However, since such minor details are well within the understanding of one skilled in the art, such scaling discrepancies, if any, in no way detract from the explanation and understanding of the invention.

Preferably, stabilizer member 160 comprises a first shoulder 162 and a second shoulder 164 both preferably integrally molded together. Because of the inclusion of this stabilizer member 160, the corresponding tongue for this second embodiment; namely tongue 158, extends from stabilizer member 160 (and not cap 154). A good illustration of this tongue 158 can be seen in FIGS. 9 and 10. Tongue 158 may be formed by using known molding process, details of which should be understood by one skilled in the art.

Operation of this second embodiment is also similar to the operation of the first embodiment, and thus repetitive details will be omitted for brevity. For example, a tab 159 is similarly provided on the surface of tongue member 158. Tab 159 will similarly releasably latch in sidewall 114 in the manner discussed above with respect to the first embodiment as article support unit 150 is disposed on mount 130. To this end, housing 110 also includes an aperture 146 or other similar means for allowing tab 159 to releasably latch into, and delatch from, sidewall 114 as should now be understood. For this reason, tongue member 158 is also sufficiently flexible for this purpose.

When cap 154 is positioned on mount 130, shoulder 162 is disposed in the portion of slot 128 formed between bracket 124 and the selected side wall 114, while at the same time, second shoulder 164 of stabilizer member 160 is disposed in the portion of slot 128 formed between second bracket 126 and selected side wall 114. The utilization of stabilizer member 160 and brackets 124 and 126 increase the securing, stabilization and positioning of article support unit 150 in housing 110 and on mount 130 in particular. A connector similar to that of connector 60 can be used in this second embodiment in a similar manner to that discussed above with respect to the first embodiment. That is, the details of FIG. 5 will be understood to apply to this second embodiment as well.

As can be seen by the foregoing, the maintenance of a coupling between the cap and the mount of the respective embodiments discourages the unauthorized decoupling and removal of the article support unit and the article from the housing, while at the same time facilitating inspection and a more intimate appreciation of the consumer article by the prospective purchaser.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense. For example, the preferred material that comprises the present invention is Polystyrene or Polycarbonate, but other materials would be understood to be applicable if desired or appropriate. Also, it should now be understood that tongue 58 and 158 can depend both downward and upwardly from their respective caps. The apertures in the sidewalls of the housing would therefore be positioned accordingly.

While the invention has been particularly shown and described with respect to preferred embodiments thereof, it will be understood by those skilled in the art that changes in form and details may be made therein without departing from the scope and spirit of the invention.

What is claimed is:

1. A display unit for a consumer article, the display unit comprising:

a housing;

a mount disposed in the housing, wherein the mount comprises at least one aperture therethrough;

an article support unit, the article support unit comprising:

an article support platform for supporting a consumer article;

a cap, the cap being coupled to the article support platform and positionable on the mount, the cap further comprising at least one aperture in at least essential alignment with the at least one aperture in the mount;

a tongue member, the tongue member extending from the article support unit and including a tab on a surface thereof, wherein the tab cooperates with a side wall of the housing to releasably lock the article support unit in place when the cap is positioned on the mount;

wherein the side wall provides for the decoupling of the tab therefrom; and a connector, threadable through the respective apertures of the cap and the mount, for maintaining a coupling of the cap and the mount when the tab of the tongue is decoupled from the side wall of the housing and the cap is removed off of the mount;

whereby the maintenance of a coupling of the cap and the mount discourages the unauthorized decoupling and removal of the article support unit and the article from the housing.

2. The display unit as claimed in claim 1, wherein the mount includes a second aperture and the cap includes a second aperture in at least essential alignment with the second aperture in the mount;

wherein the connector is threadably looped through the respectively aligned apertures.

3. The display unit as claimed in claim 1, wherein the housing includes sidewalls and one of the sidewalls of the housing includes an aperture that receives the tab of the tongue member, wherein the tab of the tongue member is displaceable out of the aperture by the pressing of the tab through the aperture in the side wall of the housing.

4. The display unit as claimed in claim 3, wherein the tab of the tongue member is displaceable out of the aperture by the pressing of a finger of a user against the tab to release the tab from the aperture.

5. The display unit as claimed in claim 3, wherein when the tab is released from the aperture the cap of the article support unit can be removed from the mount.

6. The display unit as claimed in claim 5, wherein when the article support unit is removed from the mount, the connector maintains a coupling of the mount and the cap.

7. The display unit as claimed in claim 1, further comprising:

a first bracket connected to an inner surface of a selected side wall of the housing and a second bracket also connected to the inner surface of the selected side wall and in facing alignment with the first bracket;

a stabilizer member coupled to the article support unit, the stabilizer member comprising a first shoulder and a second shoulder;

wherein the tongue member extends from the stabilizer member; and wherein when the cap is positionable on the mount, the first shoulder of the stabilizer is disposed in a portion of a slot formed between the first bracket and the selected side wall and the second shoulder of the stabilizer member is disposed in a second portion of a slot formed between the second bracket and the selected side wall.

8. The display unit as claimed in claim 7, wherein the selected side wall of the housing includes an aperture that receives the tab of the tongue member and the tab of the tongue member is displaceable out of the aperture by the pressing of the tab through the aperture in the selected sidewall of the housing.

9. The display unit as claimed in claim 8, wherein the tab of the tongue member is displaceable out of the aperture by the pressing of a finger of a user against the tab to release the tab from the aperture.

10. The display unit as claimed in claim 8, wherein when the tab is released from the aperture the cap of the article support unit can be removed from the mount.

11. The display unit as claimed in claim 10, wherein when the article support unit is removed from the mount, the connector maintains a coupling of the mount to the cap.

12. The display unit as claimed in claim 1, wherein the mount is rectangular in shape and the at least one aperture is in a top surface thereof; and wherein the cap is of a corresponding shape to the mount and the at least one aperture in the cap is in the top surface thereof and essentially aligned with the aperture in the top surface of the mount.

13. The display unit as claimed in claim 3, wherein the tongue member is flexible such that the pressing of the tab flexes the tongue member away from the sidewall and out of the aperture in the sidewall.

14. A display unit for a consumer article, the display unit comprising:

a housing;

mounting means disposed in the housing;

an article support unit, the article support unit comprising:

consumer article support means for supporting a consumer article;

positioning means corresponding to the shape of and positionable on the mounting means, the positioning means further comprising means for allowing for the coupling of the article support unit to the mounting means;

latching means, extending from the article support unit, for cooperating with a sidewall of the housing to releasably lock the article support unit in place in the housing when the positioning means is positioned on the mounting means;

wherein the sidewall provides for the decoupling of the latching means from the sidewall; and a connector for maintaining a coupling of the positioning means to the mounting means when the latching means is decoupled from the side wall of the housing and the positioning means is removed off of the mounting means;

whereby the maintenance of a coupling of the positioning means and the mounting means discourages the unauthorized decoupling and removal of the article support unit and the consumer article from the housing.

15. The display unit as claimed in claim 14, wherein the mounting means comprises at least one aperture therethrough and the positioning means comprising at least one aperture in at least essential alignment with the at least one aperture in the mounting means; and wherein the connector couples the mounting means and the positioning means by being threaded through the respective apertures in the mounting means and the positioning means.

16. The display unit as claimed in claim 14, wherein the latching means comprises a tongue member, the tongue member extending from the article support unit and including a tab on a surface thereof, wherein the tab cooperates with a side wall of the housing to releasably lock the article support unit in place when the positioning means is positioned on the mounting means.

17. The display unit as claimed in claim 16, wherein the sidewall includes an aperture that receives the tab of the tongue member, wherein the tab of the tongue member is displaceable out of the aperture by the pressing of the tab through the aperture in the sidewall of the housing.

18. A display unit for a consumer article, the display unit comprising:

a housing and a mount, the mount disposed in the housing and comprising at least one aperture therethrough;

an article support unit, the article support unit comprising:

an article support platform for supporting a consumer article;

a cap, the cap being coupled to the article support platform and positionable on the mount, the cap further comprising at least one aperture in at least essential alignment with the at least one aperture in the mount;

a tongue member, the tongue member extending from the article support unit and including means for cooperating with the housing to releasably lock the article support unit in place when the cap is positioned on the mount;

wherein the housing provides for the decoupling of the tongue therefrom; and a connector, threadable through the respective apertures of the cap and the mount, for maintaining a coupling of the cap and the mount when the tab of the tongue is decoupled from the side wall of the housing and the cap is removed off of the mount;

whereby the maintenance of a coupling of the cap and the mount discourages the unauthorized decoupling and removal of the article support unit and the article from the housing.

* * * * *